United States Patent [19]

Vadas

[11] 4,308,900

[45] Jan. 5, 1982

[54] CONTAINER FILLING SYSTEM

[75] Inventor: Leslie Vadas, Los Gatos, Calif.

[73] Assignee: FMC Corporation, San Jose, Calif.

[21] Appl. No.: 117,709

[22] Filed: Feb. 1, 1980

[51] Int. Cl.[3] ..... B65B 3/10

[52] U.S. Cl. ..... 141/1; 141/5; 141/10; 141/12; 141/91; 141/166; 141/258; 53/110; 53/407; 53/434; 53/523; 426/410; 426/412

[58] Field of Search ..... 141/1-12, 141/37, 39-64, 67-70, 89-92, 129-195, 114, 313-317, 258-262; 53/343, 110, 407, 426, 434, 523, 436; 426/410, 412

[56] References Cited

U.S. PATENT DOCUMENTS 4,016,705 4/1977 Wilson et al. ..... 53/110

*Primary Examiner*—Houston S. Bell, Jr.

*Attorney, Agent, or Firm*—A. J. Moore; R. B. Megley

[57] ABSTRACT

A container filling system and method is disclosed which includes a filling valve which receives a product through an inlet port in the side of a vertically movable cylinder having a vertically moving plunger therein that opens and closes the port. While the port is open and product is metered into the pouch, steam is directed through the filling valve to purge air from the product and from the pouch and to clean the product from the plunger. The system also includes pouch spreading fingers which leads the filling valve cylinder into the pouch to assure proper opening of the pouch. A dynamic parallelogram linkage is provided to move the filling valve and finger operating mechanisms vertically as a unit and includes resilient means which raises the filling valve above the top of the pouch in the event the power means which actuates the linkage fails.

27 Claims, 13 Drawing Figures

CONTAINER FILLING SYSTEM

BACKGROUND OF THE INVENTION

Field of the Invention

The present invention pertains to a container filling system, and more particularly relates to a container filling system for metering a predetermined volume of food product or the like into a container such as a pouch while simultaneously directing steam into the pouch.

SUMMARY OF THE INVENTION

The container filling system of the present invention is designed to direct measured amounts of product into containers, preferably pouches, rapidly and reliably. The system includes three pneumatic cylinders which first lower pouch spreading fingers into the pouch, followed by the lower end of a filling valve which enters the pouch. When the filling valve is entering the pouch a plunger within the filling valve cylinder moves upward to open an inlet opening in the cylinder. The product is then metered through the inlet opening while steam is directed through the plunger and through the product to purge air from the product and pouch and to clean product from the end of the plunger. The filling system is rapidly operated by pneumatic and electrical systems. Also, the filling valve and finger assembly are supported by a dynamic parallelogram linkage which includes a counterbalancing spring that advantageously raises the filling valve above the pouch in the event of power failure.

In accordance with the present invention a container filling system is provided which comprises means for moving a container into and out of a filling station, filling valve means at said filling station including a cylinder having an inlet port and a discharge port, a plunger mounted for vertical movement in said cylinder, power means for moving said plunger between a position closing said ports and a position opening said ports, product pumping means for moving a product through said ports into the container, said plunger when moving into port closing position being effective to close said ports and push product out of said cylinder into said container, and means for directing steam into the product as the product is being moved into the container for purging air from the product and container.

In accordance with the present invention a method of filling containers with a product from a filling valve which includes a cylinder with an inlet port and a discharge port therein, and a plunger movable between port opening and closing positions is provided; said method including the steps of moving a container into the filling station, moving the plunger to a position opening the inlet ports, forcing a measured amount of product into the container through said ports, moving the plunger into port closing position to push products remaining in the cylinder into the container, and directing steam through said plunger and discharge port while the product is being moved into the container for purging air from the product and container and for cleaning product from the end of the plunger after closing the ports.

DESCRIPTION OF THE PREFERRED EMBODIMENT

Figure 1:
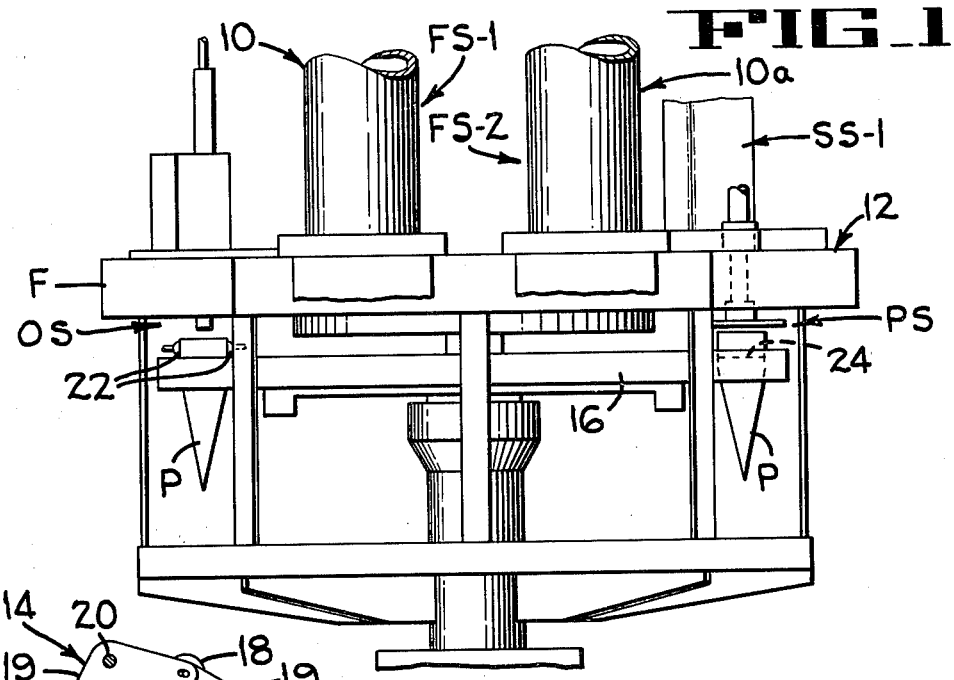
FIG. 1 is a diagrammatic side elevation of a turret type pouch filling, purging and sealing machine in which two of the container filling systems of the present invention are used.
Figure 2A:
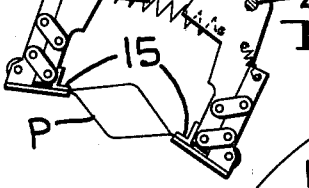
FIG. 2A is a plan of a pouch supporting mechanism at a filling station with an open pouch supported thereby.
Figure 2:
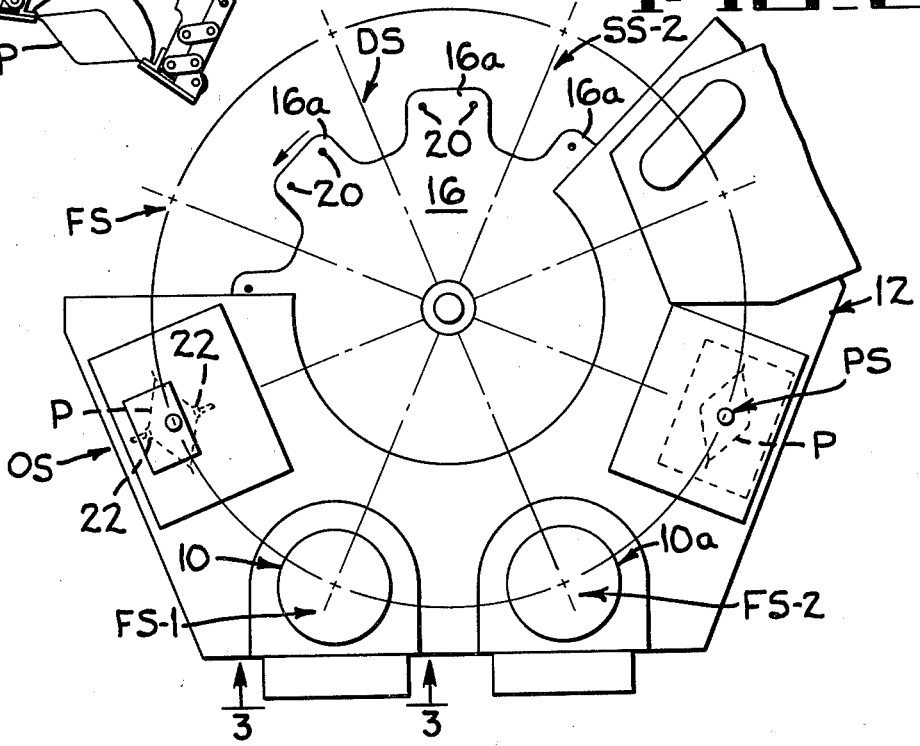
FIG. 2 is a diagrammatic plan of the machine of FIG. 1 illustrating the location of the filling station relative to other stations of the machine.

Two of the container filling systems 10 and **10*a* of the present invention are preferably used at filling stations FS-1 and FS-2 of a well known turret type pouch filling, purging and sealing machine 12 as diagrammatically illustrated in FIGS. 1 and 2. The two filling systems 10 and 10*a* are identical except that certain control components are on the right side of one valve system, while the other valve system has identical components on the left side thereof. It is believed, however, that the description of the filling valve system 10** will be sufficient for a full understanding of the invention.

In general, the machine 12 is a commercial pouch handling machine which preferably includes a feed station FS where flat pouches P are transferred from a magazine and are supported by one of several pouch supporting mechanisms 14 (FIG. 2A) by a pair of grippers 15. The pouch supporting mechanisms 14 are mounted on an intermittently driven turret 16 that advances each pouch P to a pouch opening station OS where it is opened.

Each pouch supporting mechanism 14 comprises a roller 18 loosely connected to a pair of gripper arms 19 pivoted about pins 20 secured to the turret at each tooth **16*a*** thereof. When dwelling at the opening station OS, the roller 18 moves off a fixed cam track (not shown) against an oscillating cam (not shown), which oscillating cam permits the grippers to move toward each other to an open position as a pair of suction cups 22 (FIG. 2) grip the sides of the pouch P adjacent the upper edges thereof thereby opening the upper end of the pouch to the position illustrated in FIG. 2A.

While the pouch P is at the opening station, a no pouch-no fill mechanism and its memory system detects whether or not a pouch is present and is properly opened. This no pouch-no fill mechanism and its memory system has been described in my copending application Ser. No. 110,651 which was filed on Jan. 24, 1980. This application is incorporated by reference herein.

The pouch supporting mechanism 14 and open pouch is then indexed into the first filling station FS-1 and thereafter into the second filling station FS-2 where identical and/or two different types of product may be discharged sequentially into the same pouch from filling valve systems 10 and 10*a* of the present invention. For example, the products may be meat and a sauce. The space between the product level and the upper open edges of the pouch after the pouch has received product from both systems 10 and 10*a* define a headspace 24 (FIG. 1).

After the pouch P has been filled, it is advanced to the air purging station PS where air is purged from the headspace and/or from the product if a particulate product is being packaged. At completion of the purging cycle and while at the purging station, the upper end of the pouch is closed by moving the grippers 15 away from each other in a manner well known in the art. The air purging apparatus and its method of operation are described in my copending application Ser. No. 110,652 filed on Jan. 24, 1980.

The filled, purged, and closed pouch is then advanced to a first sealing station SS-1 and thereafter to a second sealing station SS-2 where the upper end of the pouch is heat sealed by the clamping action of electrically heated sealing bars at each sealing station. The sealed pouch P is then indexed into a discharge station DS where the seals may be cooled, if necessary, by applying pressure thereto with a pair of cooling bars; and thereafter the pouch is released from the grippers 15 upon a take-away conveyor for removal of the hermetically sealed pouch from the machine.

The illustrated machine 12 is an intermittently driven, 30 pouch per minute machine with the cycle time of the machine being two seconds per cycle, and with two-thirds of a second being used to index the pouch P from thirds of asecond being used to index the pouch P from station to station.

All of the above operations, except the specific purging operation; the no pouch-no fill operation; and the operations performed by the filling system 10 of the present invention; are well known in the art and are set forth herein merely to define in general terms the operations necessary to package food or other types of products in hermetically sealed containers such as pouches P. If a more detailed description is desired for a fuller understanding of the several components (not illustrated) at the several stations, reference may be had to assignee's Wilson et al U.S. Pat. No. 4,016,705 which issued in the United States on Apr. 12, 1977 and which describes the components of an inline, rather than a turret type, machine. The disclosure of the Wilson patent is incorporated by reference herein.

In general, the container filling system 10 (FIGS. 3–7) comprises a filling valve 30 connected near its lower end to a product inlet tube 32 both of which are raised above the pouch to clear the pouch P at filling station FS-1 to permit the open pouch to enter the station and are then lowered about ½ inch into the pouch upon actuation of a first or main pneumatic (air) cylinder 34 through a forked pivotally mounted lever 36. Prior to lowering the filling valve 30 into the pouch, wedge shaped valve guiding fingers 38 (FIGS. 5 and 7) are extended by a second or finger guide air cylinder 40 below the lower end of the filling valve 30 to enter the pouch and assure that the lower end of the filling valve will not contact one or both pouch walls while attempting to enter the pouch. When the main air cylinder 34 completes lowering the filling valve into the pouch, the guide finger air cylinder 40 retracts the fingers 38 to a position level with or above the lower end of the filling valve 30 so that the fingers will not be in contact with the product metered into the pouch. With the lower end of the filling valve 30 in the pouch, a third or valve opening air cylinder 44 (FIG. 4) raises a valve opening plunger 46 above the product inlet tube 32 while directing steam through the valve plunger 46 to purge air from the product and pouch while the product is entering the pouch. After the predetermined amount of product enters the filling valve 30 and pouch, the air cylinder 44 lowers plunger 46 to close the inlet port 32 and to push any remaining product therebelow into the pouch. The steam flowing through the plunger 46 also cleans the lower end of the plunger to remove the product therefrom and minimize dripping.

A vertically elongated spring guide rod 48 moves vertically with the filling valve 30 and cooperates with a counterbalancing compression spring 50 which slightly overbalances the weight of the vertically movable components to reduce inertia and to raise the filling valve 30 from the path of movement of the pouch in the event of pneumatic or electrical failure.

Figure 8:
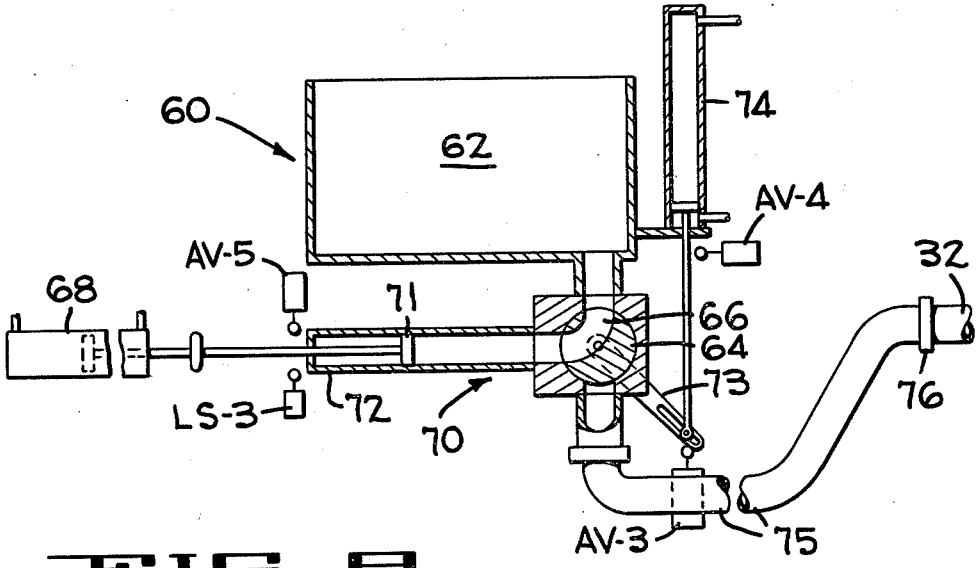
FIG. 8 is a diagrammatic vertical section of a commercially available type of food pump used for metering measured quantities of products into the filling valve system.

The product is pumped into the inlet tube 32 by a well known commercial product metering pump system 60 which system 60 forms a part of the container filling system 10 of the present invention. The pump system 60 is diagrammatically illustrated in FIG. 8 and includes a hopper 62 holding a supply of food product or the like, and a rotary valve 64 having a passage 66 therein. When the passage 66 is in the illustrated position, an air cylinder 68 operates a product pump 70 having a piston 71 in a cylinder 72 which is retracted to draw a measured amount of product into the cylinder 72. An air cylinder 74, which is connected to the valve 64 by a lever 73, then shifts the valve through 90° causing the passage 66 to communicate with the food charging cylinder 72 and with a flexible conduit or hose 75 that is connected to the inlet tube 32 of the filling valve 30 by a quick connect sanitary clamp 76. Limit switch LS-3 is actuated when the piston 71 completes its pouch filling or loading stroke. Similarly, limit switch LS-4 is actuated by the lever 73 when the valve 64 establishes communication between the charging cylinder 72, and the flexible hose 75 and filling valve 10. Also, an air valve AV-3 is actuated when the lever 73 is in the position illustrated in FIG. 8.

It will be understood that neither filling system 10 or 10*a*, when used with the illustrated pouch machine 12 will operate unless a properly positioned pouch P is detected by the no pouch-no fill mechanism described in my above mentioned copending application and an appropriate initiating signal is sent to the associated filling system 10 or 10*a*.

Figure 3:
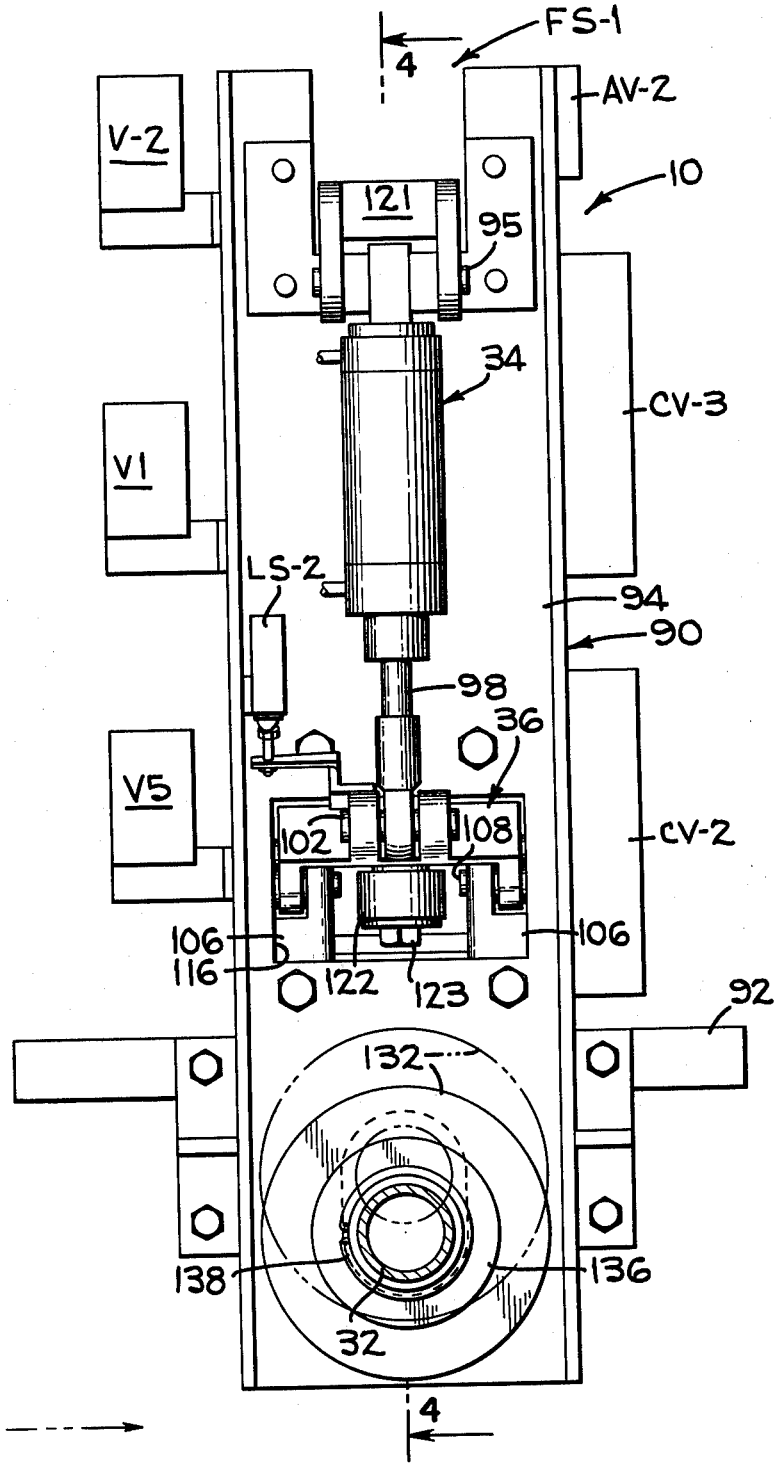
FIG. 3 is an enlarged elevation of one of the filling systems taken looking in the direction of arrows 3—3 of FIG. 2.

More particularly, the filling valve system 10 includes a sub-frame 90 (FIGS. 3–7) that is bolted to the frame F of the pouch machine 12. The sub-frame includes a horizontal plate 92 and a vertical channel 94 welded thereto and includes portions which project below the horizontal plate as best shown in FIGS. 3 and 4.

The upper end of the main cylinder 34 (FIGS. 3, 4 and 7) is pivoted by a pin 95 to a bracket 96 that is bolted to the upper portion of the channel 94. The lower end of a piston rod 98 of the main cylinder 34 is pivotally connected to one end of the forked pivot lever 36 (FIG. 8) by a pin 102. The other end of the lever 36 straddles the filling tube 30 and is pivotally connected to yokes 106 by pins 108. The yokes 106 are rigidly secured to the upper surface of an inverted guide cup 109 that serves as a movable steam trap and is rigidly secured in fluid tight engagement to the filling valve cylinder 30. The lever 36 is pivoted intermediate its ends to yokes 110 by pins 112. The yokes 110 are integrally formed on a generally U-shaped bracket 114 that is bolted to the channel 94 of the subframe 90 adjacent an opening 116 (FIG. 4) therein.

The bracket 114 is apertured to slidably receive the spring guide rod 48 (FIGS. 4 and 7) therein and acts as a base for supporting one end of the spring 50. The other end of the spring bears against a washer 117 which is secured to the upper end of the rod 48 by a pivot bolt 118 in the form of a machined eye bolt which is screwed into the upper end of the rod 48 and is locked in adjusted position by a locknut 119. A pivot pin 120 is secured to the eye bolt 118 and is pivotally connected to one end of a curved, bifurcated pivot bracket 121 having its other end pivoted about the axis of the pivot pin 95 that forms the pivot axis of the upper end of the main cylinder 34.

Figure 4:
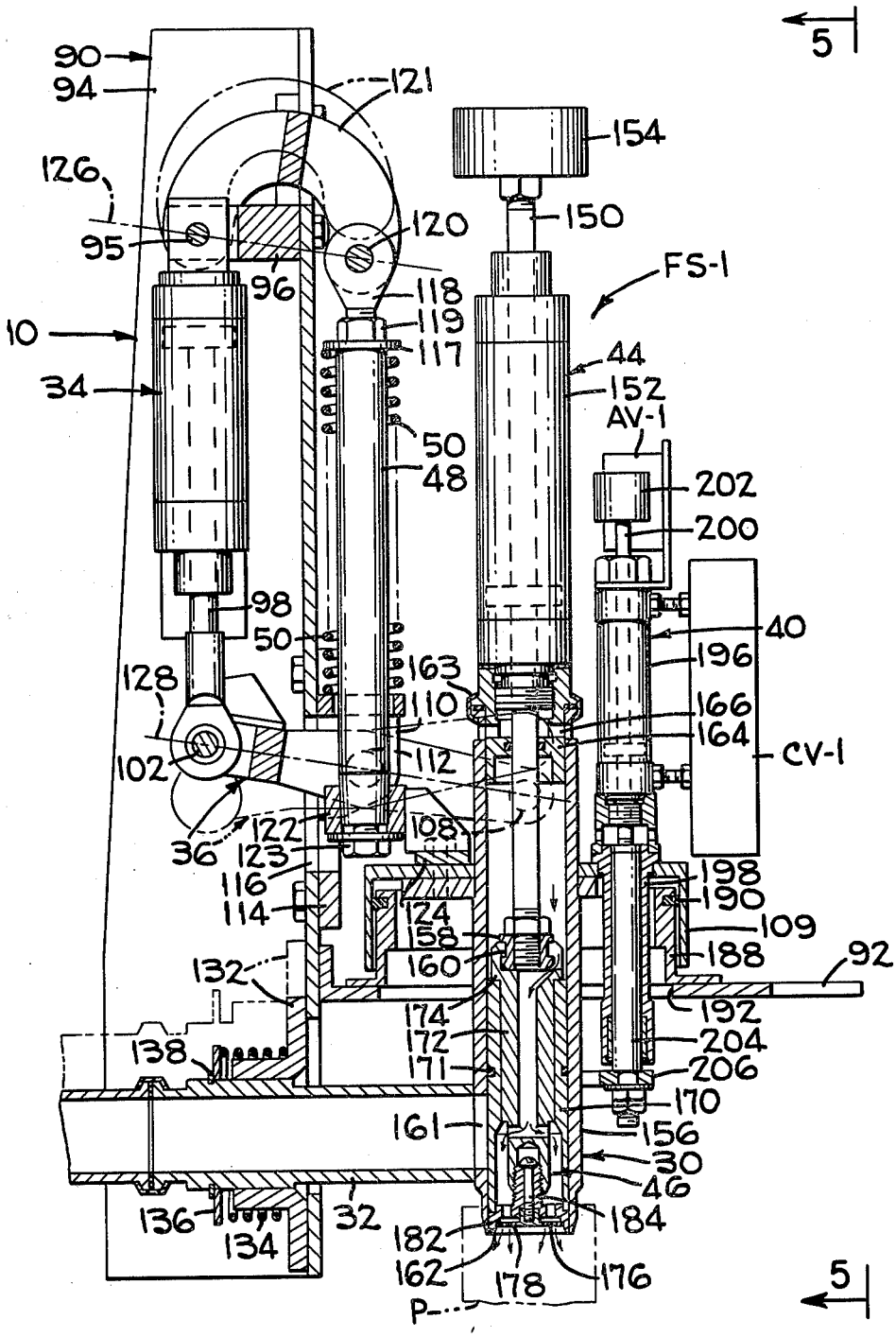
FIG. 4 is a central vertical section taken along lines 4—4 of the filling system of FIG. 3.
Figure 7:
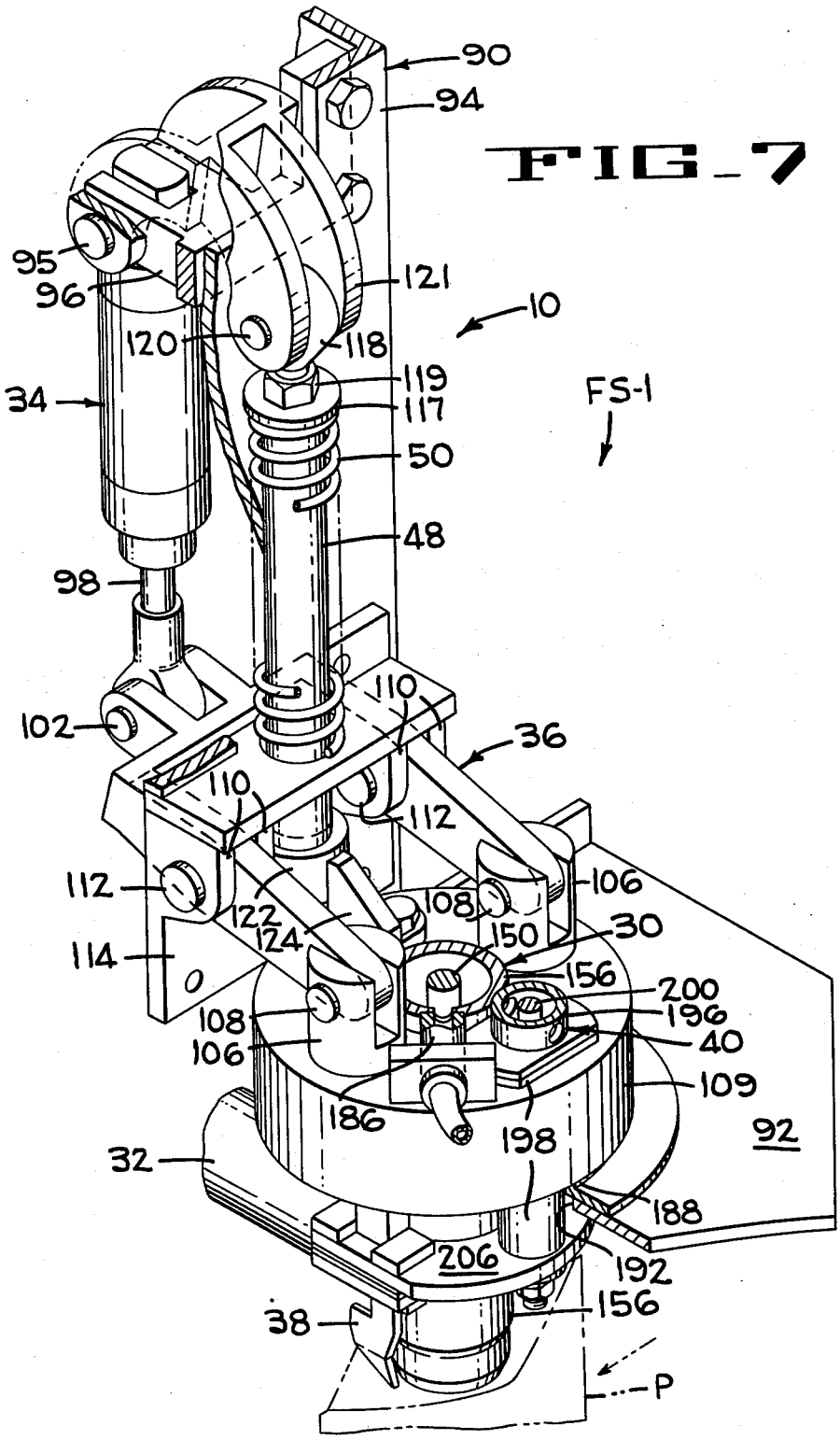
FIG. 7 is a diagrammatic perspective of the working components of the valve system with certain parts cut away to more clearly illustrate the mode of operation of the filling valve system, said view being taken looking in the direction of arrows 7—7 of FIG. 6.

As best shown in FIGS. 4 and 7, the lower end of the guide rod 48 is tapered and is rigidly secured within a tapered ring 122 by a washer and capscrew 123. The ring 122 is rigidly secured to a bracket 124 bolted to the inverted guide cup 109. In will be appreciated that the distance between pivot pins 112 and 120 may easily be adjusted by merely loosening the locknut 119 and capscrew 123 and then rotate the guide rod 48 in the proper direction until the desired length is achieved. In order to assure vertical movement of the filling valve 30 through its approximate 1 inch stroke, the distance between the pivot pins 95 and 120 is the same as the distance between the pivot pins 102 and 112, and between the pivot pins 108 and 112. Axes 126 and 128 (FIG. 4) intersecting the pivot points of the upper set of pivot pins 95, 120; and the lower pivot axes of pins 102, 108, 112 respectively, remain parallel at all times during vertical movement of the filling valve 30 because the spring 50 moves the pivot pin 120 the same distance as the pivot pin 102 is moved by the main cylinder 34 but in the opposite directions during vertical movement of the filling valve 30. The pivot pins 120 and 102 define dynamic pivot pins since they move in opposite directions, while the pivot pins 95 and 112 define fixed pins since they are secured to the sub-frame 90. Thus, a dynamic parallelogram linkage is provided assuring that the filling valve 30 and the rod 48 both move vertically when the main cylinder 34 is actuated thereby precluding binding between adjacent moving parts even though arcuate movement of the forked pivot lever 36 moves the filling valve 30 horizontally a minute amount during its travel.

In order to close an oval opening through which the inlet tube 32 travels, flange 132 is slidably received on the filling tube 32 and is urged against a flat vertical face of the vertical channel frame member 94 by a spring 134. The other end of the spring 134 bears against a ring 136 secured to the tube 32 by a snap ring and slot 138.

The filling valve 30 (FIG. 4) is not only raised and lowered in its entirety by the air cylinder 34 as above described, but also has its plunger 46 raised and lowered by the valve air cylinder 44 in timed relation with the movement of the other components of the filling system 10.

The air cylinder 44 is a double acting cylinder with its piston rod 150 projecting out of both ends of its cylindrical housing 152. A valve actuator 154 is mounted on the upper end of the piston rod, and the lower end of the rod projects into the valve cylinder housing 156 (FIG. 4) of the filling valve 30 and is connected to the upper end of the plunger 46 by a collar 158 having an annular groove 160 therein. The valve housing 156 has an inlet opening 161 in its side communicating with the inlet tube 32, and a discharge opening 162 in its lower end.

The upper end of the plunger 46 is provided with surfaces that mate with the collar surfaces but has its right portion cut away providing a U-shaped slot slightly larger in width than the diameter of the groove 160 to permit assembly and disassembly of the plunger from the collar 158 by moving the plunger 46 to the left (FIG. 4) relative to the collar 158 after first pulling the plunger upwardly out of the valve cylinder 156 for cleaning or the like.

Figure 6:
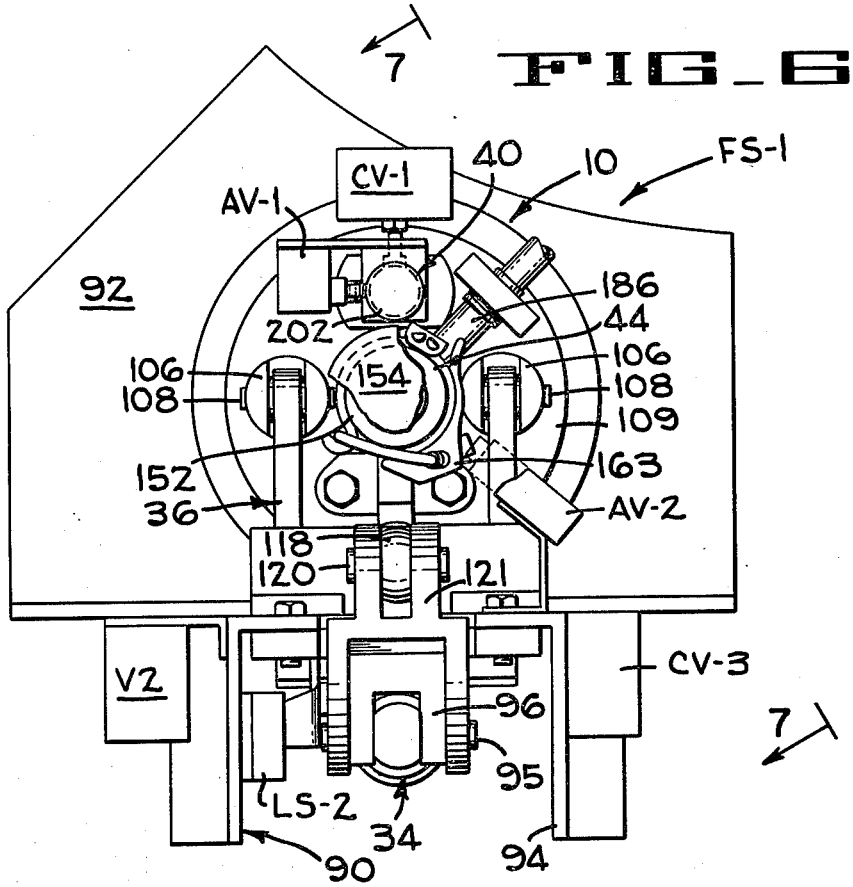
FIG. 6 is a plan view of the container filling system, certain parts being broken away.

As indicated in FIGS. 4 and 6, the air cylinder housing 152 and the valve housing 156 are easily disconnected by releasing a sanitary clamp 163 from flanged end portions of the two housings. The lower portion 164 of the air cylinder housing 152 is reduced in diameter and, when in operating position, is slidably received in the upper end of the filling valve housing 156 and is sealed in fluid tight engagement to the valve housing 156 by the clamp 163 and suitable seals. Mating ports 166 in the lower portion 164 of the air cylinder and in the valve housing 156 are aligned before clamping the air cylinder 44 to the valve 30 and permits lubricant or the like to drain from the air cylinder 44 without contaminating the filling valve 30 and also prevents steam from entering the air cylinder 44.

As mentioned previously, steam is directed into the pouch P during filling to assist in purging air from the product and to provide somewhat of a steam atmosphere at the filling station FS-1. In order to provide steam passages in the plunger 46, which aid in cleaning the plunger, the plunger is formed in several pieces which include an outer cylindrical tube 170 that is slidably sealed to the cylinder housing 156 by an O-ring 171. An inner cylindrical tube 172 is slidably received in the outer tube 170 and has an enlarged head 174 abutting the upper end of the outer tube 170. A reduced diameter lower end portion of the inner tube 172 is threaded to receive a product pushing steam nozzle 176. The nozzle 176 includes a perforated product pushing disc 178 having a hub which enters an annular recess in a large diameter nozzle head 182, and is connected thereto by a screw 184. The shank of the nozzle head is screwed into the threaded lower portion of the inner tube 172 and has a shoulder that abutts the lower end of the outer tube 170. Thus, when the nozzle head 182, is tightened the several components of the plunger 46 are rigidly connected together.

Steam enters the filling nozzle 30 through a conduit 186 (FIGS. 6 and 7) that is clamped to the cup 109. The steam then flows through passages in the plunger 46, as indicated by the arrows in FIG. 4, into the pouch as the product is metered into the pouch. This steam assists in purging air from the product and pouch at the filling station FS-1 thus providing a steam or steam-air atmosphere at the filling station. The vertically movable inverted cup 109 is provided to capture this steam to retain a steam atmosphere around the upper end of the pouch at the filling station FS-1. As shown in FIG. 4, the skirt of the vertically movable cup 109 is sealed to an annular guide 188 by a seal ring 190. The annular guide 188 is secured to the horizontal plate 92 of the subframe 90 about a large hole 192 therein. As mentioned previously, the vertically movable spring loaded flange 132 effectively seals the vertically elongated slot in the vertically extending channel frame member 94.

Figures 5, 5A:
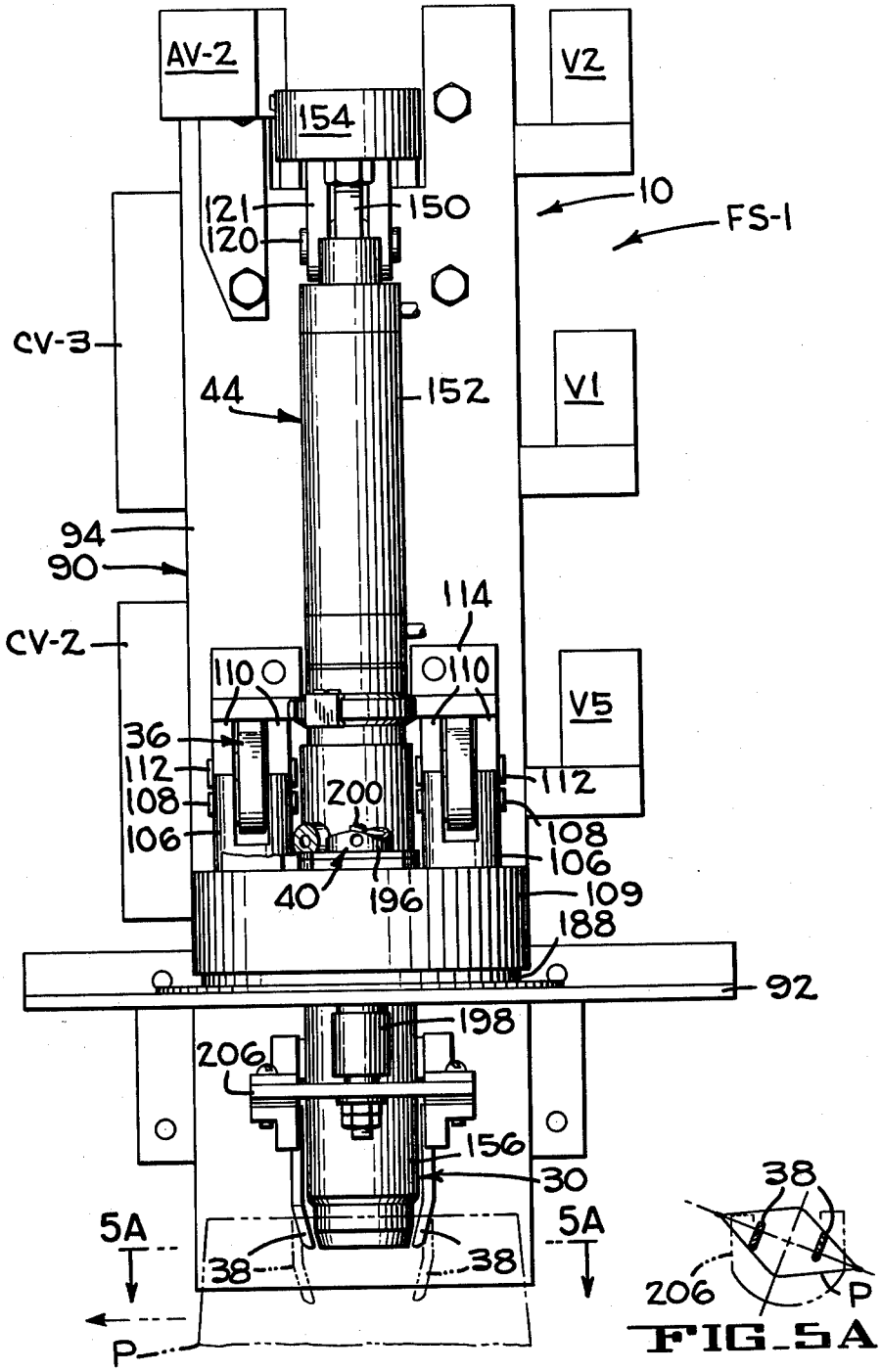
FIG. 5 is an elevation of the filling valve system taken along lines 5—5 of FIG. 4 illustrating the opposite side of the valve system relative to FIG. 3, certain parts being cut away to more clearly illustrate other parts.
FIG. 5A is a horizontal section taken along lines 5A—5A of FIG. 5 through the fingers illustrating their relationship with the longitudinal axis of the pouch opening and to the turret radii.

The valve guiding fingers 38 enter the pouch P at the filling station FS-1 to assure that the pouch is opened sufficiently to receive the lower end of the filling valve 30. The fingers are raised and lowered by the finger guide air cylinder 40. The housing 196 of the air cylinder 40 has feet (FIG. 6) that are bolted to the vertically movable cup 109, and the feet clamp a push rod guide sleeve 198 (FIG. 4) to the cup. The piston rod 200 of the air cylinder 40 projects out both the upper and lower ends of the housing 196 to carry a valve actuator 202 (FIG. 4) on its upper end and a push rod 204 on its lower end. The push rod 204 is screwed into the piston rod 200, and has a shouldered lower end to which a U-shaped finger carrier 206 is secured by nuts. As best shown in FIGS. 5 and 7, the fingers 38 are bolted to the carrier 206 on opposites sides of the lower portion of the filling valve 30 in 22½° offset of the valve center parallel to the longitudinal axis of the pouch opening as shown in FIG. 5A to engage and spread the walls of the pouch P if the walls are not already properly spread. As shown in FIG. 7, the fingers are generally V-shaped and are angled inwardly toward the filling valve 30.

Figure 10:
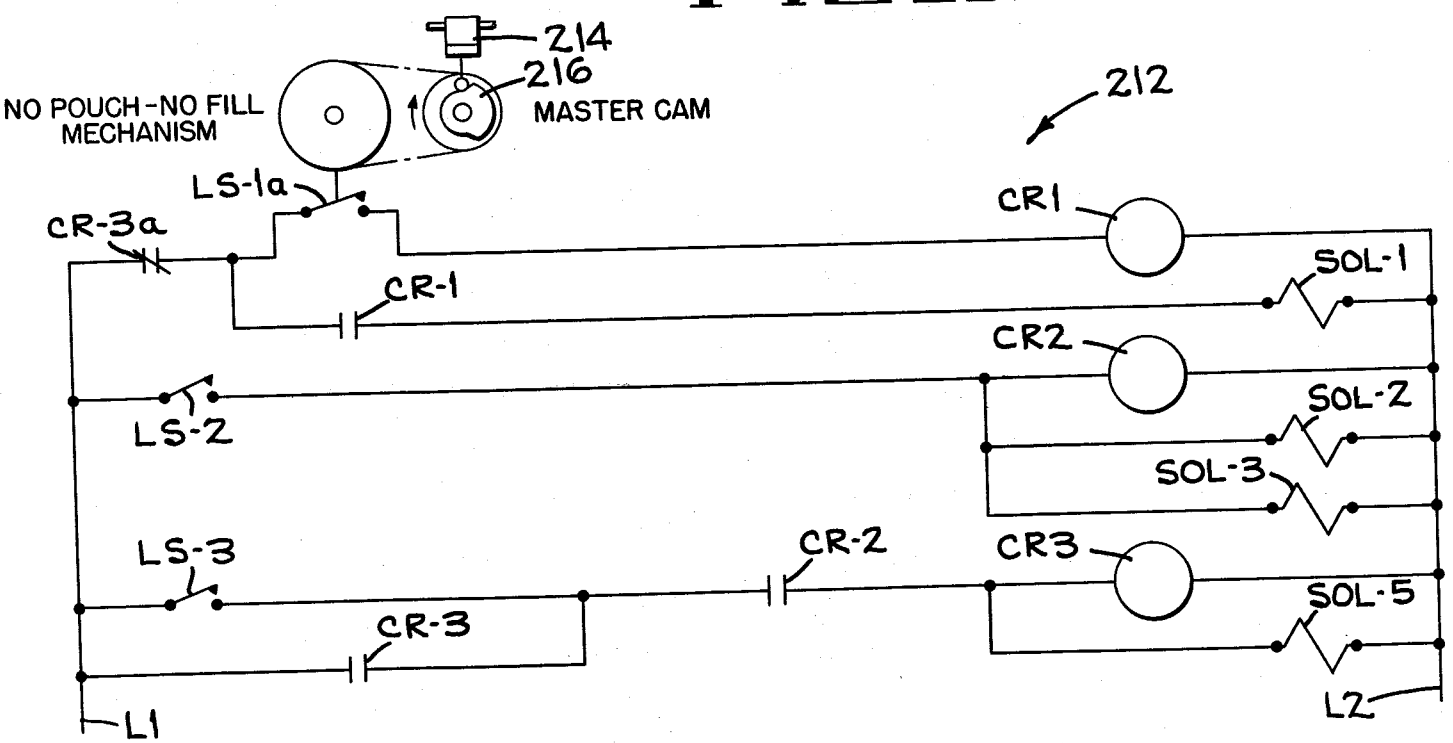
FIG. 10 is an electrical control system which cooperates with the pneumatic control system.
Figure 11:
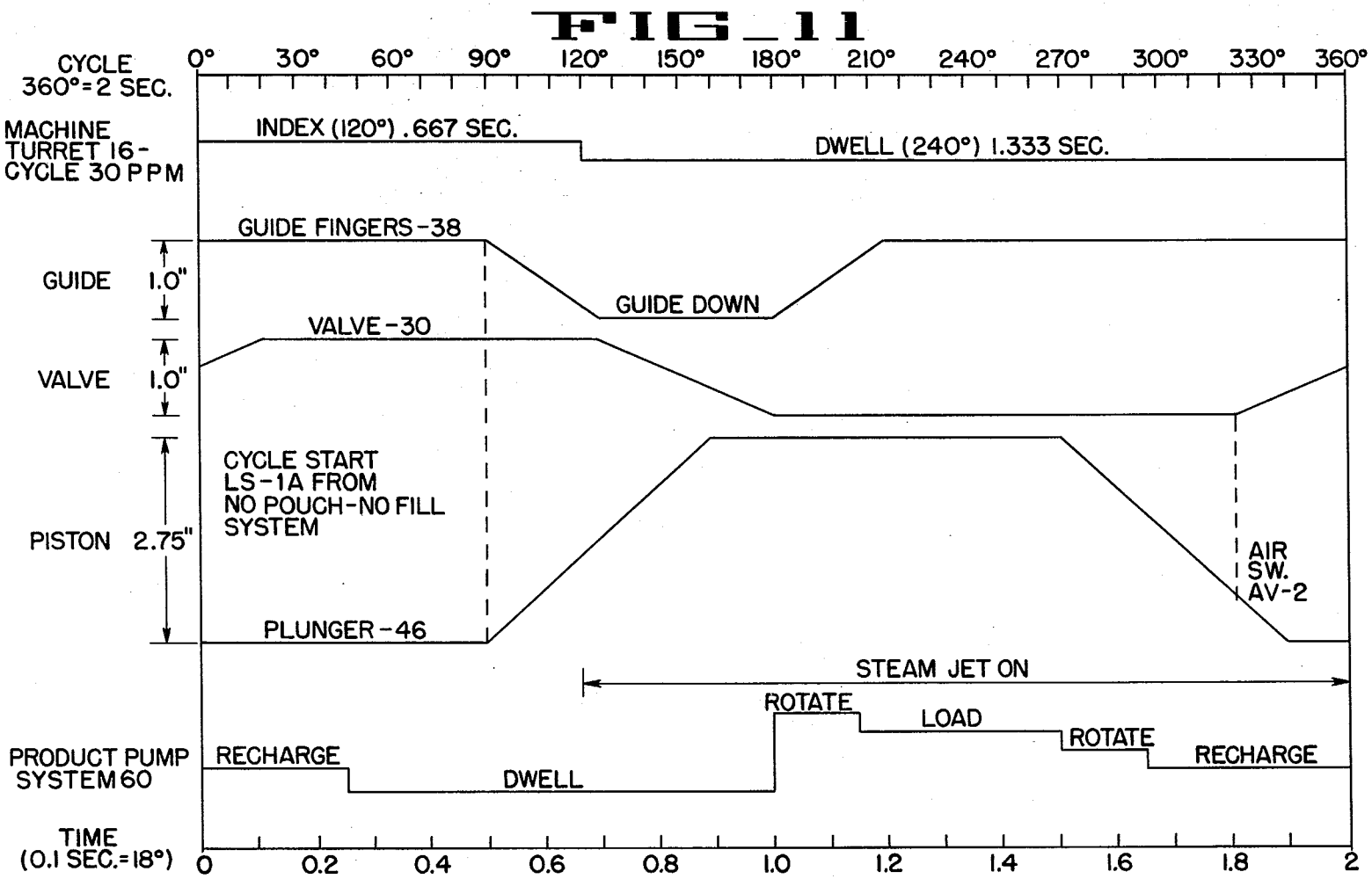
FIG. 11 is a timing diagram illustrating the timing of the several components of the filling valve system including the point at which the no pouch-no fill mechanism initiates the cycle.

The operation of the filling valve system 10 of the present invention will be described along with a pneumatic control circuit 210 (FIG. 9), a cooperating electrical circuit 212 (FIG. 10), and timing diagram (FIG. 11).

Figure 9:
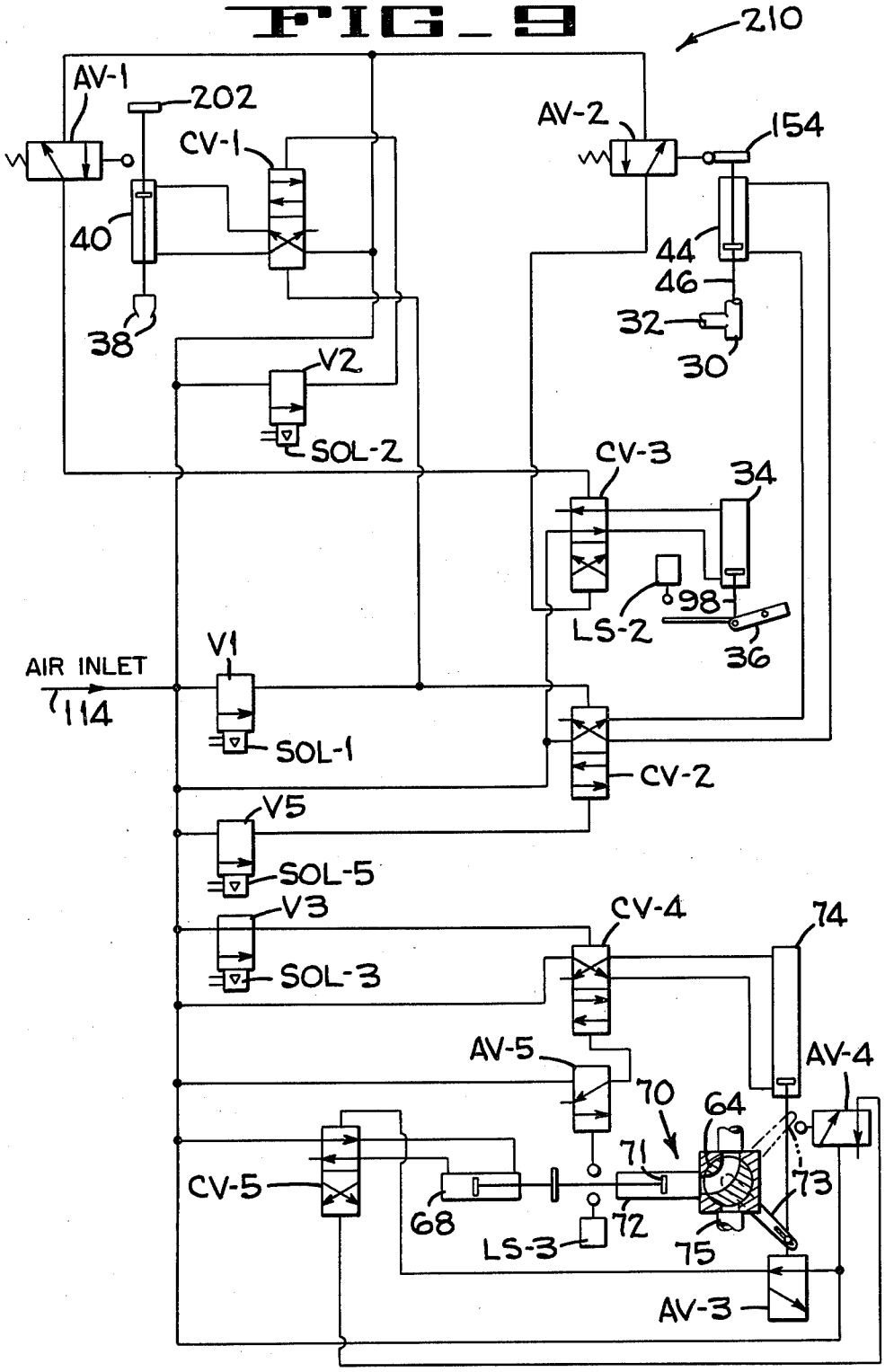
FIG. 9 is a diagrammatic pneumatic control system for actuating and controling components of the present invention.

Each cycle of operation of the filling system 10 starts when fingers 38 (FIG. 7) are up, and the valve plunger 46 is in its lowered position closing the inlet passage 32. For ease in describing the operation, the filling valve will be described as though it is in the full up position although it is not fully up at the start of the cycle as indicated in FIG. 11. The product pump 70 of the pump system 60 is approaching but not as yet fully within its retracted or recharging position but is being recharged with the product at the start of the cycle. Also, at this time the rotary product valve 64 of the pump system (FIG. 8) is in its illustrated position permitting the product pump 70 to become recharged with a predetermined amount of product from a product hopper 62. The positions of the pistons in the several air cylinders are as illustrated in FIG. 9 when a filling cycle is to be started.

In order to start the filling cycle, the no pouch-no fill device, wich is fully disclosed in my cross referenced copending application Ser. No. 110,651, must signal that a properly opened pouch will be in the filling station FS-1 before the system is ready to cycle and to meter the predetermined amount of product into the pouch. In response to the detection of such a pouch, the no pouch-no fill mechanism closes switch LS-1*a* (FIG. 10) thus initiating the filling cycle by energizing solenoid SOL-1 (FIG. 9) opening air valve V1 directing high pressure air from inlet 114 through valve V-1 and pilot lines to the pilot operated control valves CV-1 and CV-2. The core of control valve CV-1 shifts upwardly to the illustrated cross passage position directing high pressure air downwardly in finger cylinder 40 while venting the lower end of the cylinder thereby lowering the fingers 38. Simultaneously, the core of the control valve CV-2 shifts downwardly to the illustrated position to direct high pressure air into the lower end of valve air cylinder 44 thereby raising the filler piston or plunger 46 to open the port or passage 161 of the inlet tube 32.

When the fingers 38 are in the down position, the core of air valve AV-1 shifts to the left (FIG. 9) thereby directing pilot pressure into the upper end of control valve CV-3 shifting its core downwardly to the illustrated parallel passage position. High pressure air then flows to the lower end of main cylinder 34 thus raising the piston rod 98 causing the lower end of filling valve 30 to enter the pouch by virtue of lever 36.

At this point it should be pointed out that the internal circuits of the above mentioned prior art product pump 70 (FIG. 8) are used for controlling the actual operation of the pump, and that the following circuits relating to the product pump 70 are merely illustrative of circuits which may be used to control the filling stroke and recharging stroke of the product pump piston 71. The air cylinder 68 actuates the piston 71, and the air cylinder 74 actuates the rotary valve 64.

As mentioned previously, the product pump 70 has not completed its recharging stroke at the start of the cycle as indicated in the timing chart of FIG. 11. Thus, the rotary product valve 64 is likewise in its recharging position and must be rotated 90 degrees before the product can be metered into the pouch by the piston 71. This action takes place in response to the filling valve reaching its full down position thereby closing limit switch LS-2 (FIG. 9).

When switch LS-2 is closed it actuates solenoids SOL-2 and SOL-3 thereby opening solenoid valves V2 and V3, respectively. Opening valve V2 reverses the pilot pressure to control valve CV-1 and thus lowers the core of control valve CV-1 to the parallel passage position thereby raising the piston of cylinder 40 which lifts the fingers 38 above the lower end of the filling valve 30 so that they will not become contaminated with the product. Opening control valve V3 actuates the product pump valve 64 by first lowering the core of the control valve CV-4 to the illustrated cross passage position thereby retracting the piston rod of cylinder 74 and actuating air valve AV-4 at the upper end of the stroke.

Air valve AV-4 shifts control valve CV-5 into its cross passage position directing air into cylinder 68 which meters a measured amount of product from product pump 70 into the filling valve 30. Upon completion of its stroke, the piston of cylinder 68 actuates limit switch LS-3 which energizes solenoid SOL-5 opening valve V-5 and reverses control valve CV-2 causing cylinder 30 to lower the plunger 46 into position to close inlet tube 32, and transfer product from the valve into the pouch. Closing LS-3 also opens air valve AV-5 raising the core of control valve CV-4 returning the rotary product valve 64 to its illustrated recharging position thereby actuating air valve AV-3 which shifts the core of the control valve CV-5 downwardly to its illustrated parallel passage position to direct air into cylinder 68 thus recharging the food pump 70 and completing the cycle of operation.

The electrical circuit 212 (FIG. 10) for controlling the above described pneumatic circuit 210 has already been partially referred to during the description of the pneumatic circuit. The electrical circuit receives its power from main line L1 and L2 and is inoperative until a properly opened pouch P is detected entering the filling station FS-1 (FIGS. 1 and 2) and the aforementioned no pouch-no fill device closes switch LS-1*a*.

Closing switch LS-1*a* energizes relay CR1 closing relay contact CR-1 thus providing a holding circuit across switch LS-1*a*. Solenoid SOL-1 is then energized through a circuit which includes normally closed relay contact CR-3*a* and closed contact CR-1 thereby causing the pneumatic system to raise the plunger 46 of the filling cylinder 30 and lower the pouch spreading fingers 38 as previously described. With the fingers 38 down, air valve AV-1 (FIG. 9) is actuated to effect lowering of the lower end of the filling valve 30 into the pouch, and upon reaching the bottom of its stroke closing switch LS-2.

Closing switch LS-2 energizes relay CR2 closing relay contact CR-2 in the product pump circuit and also energizing solenoids SOL-2 and SOL-3. Energization of solenoid SOL-2 causes the fingers 38 to raise; and energization of the solenoid SOL-3 causes the product valve 64 to rotate into the product metering position. Upon completion of rotation of the product valve 64, the valve arm closes air valve AV-4 thereby moving piston 71 of the product pump 70 to the right discharging a measured amount of product into the filling valve 30.

Upon completion of the product filling stroke, switch LS-3 is closed energizing relay CR3. Energization of relay CR3 opens relay contact CR-3*a* thus breaking the circuit to solenoid SOL-1. Energization of relay CR3 also closes relay contact CR-3 to provide a holding circuit across switch LS-3. Closing switch LS-3 energizes solenoid SOL-5 which lowers the filling valve plunger 46 and closes air valve AV-2. Opening air valve AV-5 extends the piston of cylinder 74 thereby returning the rotary product valve 64 to its initial position and opening air valve AV-3. Air valve AV-3 then retracts the product pump piston 71 in a recharging stroke thus completing the cycle of operation.

FIG. 11 illustrates the timing of the many components of the filling valve system of the present invention including the functions performed by the product pump. The chart relates these functions to the 30 pouch per minute machine 12, and its intermittently driven turret 16 which has a cycle time of 2 seconds per cycle.

It will be understood that well known adjustable speed control valves (not shown) are included in the pneumatic circuit 210 to provide the desired rate of movement of the different components. It will also be understood that by combining the electric circuit 212 and the pneumatic circuit 210 for operating the several components, that a much faster action is achieved than could be achieved by the pneumatic system alone. Because of the inherently slower action of the pneumatic system, it will be noted that the downward movement of the guide fingers 38 (FIG. 5) and the upward movement of the plunger 46 begin before the turret 16 stops its indexing movement; and that the filling valve 30 completes its upward movement after the product has been discharged into the pouch during the next indexing cycle of the turret.

As indicated in FIG. 11, the cycle time for a full 360° cycle requires two seconds with the turret 16 indexing for 120° of the cycle time requiring $\frac{2}{3}$rds of a second thereby providing a dwell of the turret 16 at the filling station for only $1\frac{1}{3}$ seconds.

At the start or 0° point in the cycle, the guide fingers 38 are up, the filling valve 30 has almost reached its uppermost position, the plunger 46 is in its lowermost or closed position, and the product pump 70 is in the process of being recharged with a product.

The guide fingers 38 start moving down to guide the valve 30 into the pouch and the plunger 46 starts moving up at the 90° point in the cycle at which time the valve is up. The fingers terminate their downward movement at 125° while the plunger 46 is still moving up through its $2\frac{3}{4}$ inch stroke and terminates its upward movement at 160°. The valve 30 starts moving down at 125° of the cycle and terminates its downward movement at 180° with the fingers down through the entire downward movement of the valve 30 thus guiding the valve 30 into the pouch. At the 180° position, three functions occur: the fingers 38 start up and terminate their upward movement at 215°; the valve 30 remains down and doesn't start up until reaching the 325° position, and the product pump valve 64 starts rotating through 90°. Upon completion of rotation of the product valve 64, the pump 70 meters a predetermined amount of product into the pouch at 270° thereby initiating return of the product valve 64 to its original position at which time recharging of the product pump 60 begins and ends at about 45° in the next turret indexing cycle.

After the product has been pushed from the product pump 60 into the filling valve at about 270° of the cycle, the plunger 46 moves downwardly into passage blocking position at about 340° and remains there until the cycle has been completed. The filling valve 30 begins to raise at about 325° of the cycle and terminates its upward movement at 20° of the next cycle.

The steam jet cycle for purging air from the product while the product is entering the pouch starts at about 120° and remains in effect to the end of the cycle. The steam jet also cleans product from the plunger 46 and filling valve 30 thus eliminating dripping between cycles. A conventional steam valve, such as valve 214 (FIG. 10) which is actuated by a one revolution per cycle cam 216, is provided for turning the steam on and off at the appropriate times.

Since accurate control of the rate of movement of air cylinders is difficult to achieve, it will be understood that the above points in the timing cycle are the preferred points and that small variations from these points may occur in actual practice.

From the foregoing description it is apparent that a combination electric and pneumatic control system is provided to rapidly perform a sequencing plurality of separate functions involved in discharging a measured amount of product into a pouch, but only if a pouch is present to receive the product. The filling valve system directs steam into the product as it is being metered into the pouch to purge air from the product and pouch, and to clean the filling valve plunger minimizing dripping when moving between cycles. A unique three point, spring loaded dynamic parallogram linkage is provided for assuring that the filling valve moves vertically at all times and that failure of an air line or the like during operation will raise the filling valve to a level above the pouch.

Although the best mode contemplated for carrying out the present invention has been herein shown and described it will be apparent that modification and variations may be made without departing from what is regarded to be the subject matter of the invention.

I claim:

1. A container filling system comprising means for moving a container into and out of a filling station; filling valve means at said filling station including a cylinder having an inlet port and a discharge port, a plunger mounted for vertical movement in said cylinder, power means for moving said plunger between a position closing said ports and a position opening said ports, product pumping means for moving a product through said ports and into the container, said plunger when moving into port closing position being effective to close said ports and push product out of said cylinder into said container, and means for directing steam into the product as the product is being moved into the container for purging air from the product and the container.

2. A system according to claim 1 wherein said product pumping means meters a predetermined amount of product into said container.

3. A system according to claim 1 and additionally comprising main power means for moving a portion of said cylinder into said container prior to the product moving through said ports, and for moving the cylinder of the filling valve means out of the container when the container is being moved out of said filling station.

4. A system according to claim 3 wherein the container is a pouch, and additionally comprising a pair of fingers, and finger moving power means for moving the fingers into the pouch prior to moving said cylinder into the pouch to spread the walls of the pouch sufficiently to receive said cylinder, said finger moving power means lifting the fingers to at least the level of the lower end of said cylinder prior to moving the product therethrough for preventing contamination of said fingers.

5. A system according to claim 3 wherein said power means for said plunger moves said plunger upwardly while said finger moving power means is moving the finger downwardly.

6. A system according to claim 5 wherein said main power means, said power means for said plunger, and said power means for said fingers all include pneumatic cylinders.

7. A system according to claim 4 wherein said fingers, said finger power means, said plunger, and said plunger power means are raised and lowered as a unit by said main power means.

8. An apparatus according to claim 3 wherein said main power means includes a dynamic parallelogram linkage comprising a stationary frame, means defining a first fixed pivot point secured to said frame, an extendable and retractable main power means having one end pivoted to said first pivot point, a lever pivotally mounted intermediate its ends to said frame at the second fixed pivot point, means pivotally connecting one end of said lever to the other end of said main power means at a first dynamic pivot point and at a predetermined distance from said second pivot point, a pivot arm having one end pivotally connected to said first fixed pivot means, an elongated rod having one end pivotally connected to said pivot arm at a second dynamic pivot point at said predetermined distance from said first fixed pivot point, said elongated rod having a longitudinal axis passing through said second fixed pivot point and said second dynamic pivot point, means pivotally connecting the other end of said lever to said filling valve means, means rigidly connecting the other end of said rod to said filling valve means, and resilient means connected between said rod and said frame and being responsive to move said second dynamic pivot point an amount equal to but in the opposite direction to the movement of said first dynamic pivot point by said main power means.

9. An apparatus according to claim 8 wherein said resilient means is a compression spring which exerts more force than the force exerted by said main power means for moving said filling valve to a position above the container in the event of power failure to said main power means.

10. A method of filling containers with a product from a filling valve which includes a cylinder with an inlet port and a discharge port therein, and a plunger movable between port openings and port closing positions: said method including the steps of moving a container into a filling station, moving the plunger to a position opening the inlet and discharage ports, forcing a measured amount of product into the container through said ports, moving the plunger into port closing position to push product remaining in the cylinder into the container, and directing steam through said plunger and discharge port while the product is being moved into the container for purging air from the product and container and for cleaning product from the end of the plunger after closing the ports.

11. A method according to claim 10 and additionally including the step of moving a portion of the filling valve into the container prior to directing the product into the container, and moving the valve out of the container after completion of the filling operation.

12. A method according to claim 11 wherein the container is an open pouch having spaced sidewalls, and additionally comprising the step of moving a pair of fingers disposed on opposite sides of the filling valve cylinder into the pouch for spreading the sidewalls prior to the cylinder entering the pouch, and retracting the fingers above the discharge port prior to discharging product therethrough for preventing contamination of the fingers by the product.

13. A method according to claim 12 wherein the guide fingers are moved downwardly into the pouch when the plunger is being moved upwardly into said port opening position.

14. A method according to claim 13 wherein the downward movement of the filling valve is initiated upon completion of the downward movement of the fingers, said filling valve terminating its downward movement after the plunger has fully opened the inlet port.

15. A method according to claims 11 or 12 wherein the filling valve is vertically disposed and additionally comprising the step of resiliently counterbalancing the weight of the filling valve for minimizing inertia during movement of the filling valve.

16. A method according to claims 10 or 11 including the step of retaining a steam environment around the container when in the filling station.

17. A dynamic parallelogram linkage having two fixed pivot points and two dynamic pivot points; said parallelogram linkage comprising: a stationary frame, means defining a first fixed pivot point secured to said frame, an extendable and retractable power means having one end pivoted to said first pivot point, a lever pivotally mounted intermediate its ends to said frame at the second fixed pivot point, means pivotally connecting one end of said lever to the other end of said power means at a fixed dynamic pivot point and at a predetermined distance from said second pivot point, a pivot arm having one end pivotally connected to said first pivot means, an elongated rod having one end pivotally connected to said pivot arm at a second dynamic pivot point at said predetermined distance from said first fixed pivot point, said elongated rod having a longitudinal axis passing through said second fixed pivot point and said second dynamic pivot point, a tool, means pivotally connecting the other end of said lever to said tool, means rigidly connecting the other end of said rod to said tool, and resilient means connected between said rod and said frame and being responsive to move said second dynamic pivot point an amount equal to but in the opposite direction as the movement of said first dynamic pivot point by said power means.

18. An apparatus according to claim 17 wherein said tool is a filling valve.

19. An apparatus according to claims 17 or 18 wherein said resilient means is a compression spring which exerts more force than the force exerted by said power means for moving said tool to a retracted position in the event of power failure to said power means.

20. An apparatus according to claim 17 wherein said tool is an elongated tool having a longitudinal axis parallel to the axis of said rod, wherein the points of connection of said lever to said tool are on diametrically opposite sides of said tool, and wherein the point of connection of said rod to said tool is disposed outwardly from the axis of said tool at a point equally spaced from said points of connection of said lever to said tool to provide a stable three point suspension system for said tool.

21. A pneumatic-electric sequencing control method for a container filling system associated with a no container-no fill mechanism: said method including the steps of initiating a filling cycle only in response to a container being present and capable of receiving a product; said cycle upon being initiated including: moving a filling valve down into the open end of the container, raising a plunger within the filling valve to open the filling valve to a source of product and to the container forcing a predetermined charge of product through the filling valve into the container, capturing a new charge of product in readiness for the next cycle, lowering the plunger within the filling valve to discharge any remaining product in the valve into the container, returning the components of the container filling system to their initial neutral position, and holding the components of the container filling system in a neutral position until the no container-no fill mechanism initiates another cycle.

22. A method according to claim 21 wherein the container is a pouch, and additionally comprising the steps of moving valve guiding fingers into the pouch to spread the walls of the pouch prior to lowering the filling valve into the pouch, and subsequently raising the fingers out of the pouch prior to forcing the charge of product into the pouch.

23. A method according to claim 22 wherein the guide fingers are lowered simultaneously as the plunger is being raised.

24. A method according to claims 22 or 23 wherein the guide fingers terminate their downward movement relative to the filling valve simultaneously with the initiation of downward movement of the filling valve, and wherein said plunger terminates its upward movement prior to the completion of downward movement of the filling valve.

25. A method according to claim 24 wherein termination of the step of forcing the charge into the filling valve and pouch occurs simultaneously with the initiation of the return of the plunger to its initial position.

26. A method according to claim 21 and additionally comprising the step of directing steam through the product and into the pouch as the product is being forced through the filling valve into the container.

27. A method according to claim 25 wherein all the steps of the filling cycle take place within about two seconds.

* * * * *